United States Patent [19]

Arpine

[11] Patent Number: 4,506,499

[45] Date of Patent: Mar. 26, 1985

[54] REEL SUPPORT SYSTEM

[75] Inventor: Donald A. Arpine, Hamden, Conn.

[73] Assignee: The Watson Machine Company, Paterson, N.J.

[21] Appl. No.: 567,804

[22] Filed: Jan. 3, 1984

[51] Int. Cl.[3] ..... D07B 7/06; D07B 3/02

[52] U.S. Cl. ..... 57/127.5; 57/65; 57/127.7; 242/129.6

[58] Field of Search ..... 57/127.5, 127.7, 64, 57/65, 66.5, 58.32; 242/129.5–130

[56] References Cited

U.S. PATENT DOCUMENTS 4,079,580 3/1978 Varga ..... 57/127.5

4,130,985 12/1978 Varga ..... 242/129.6 X 4,369,619 1/1983 Nielsen et al. ..... 57/127.7 X 4,406,423 9/1983 Saller ..... 57/127.5 X

*Primary Examiner*—John Petrakes

*Attorney, Agent, or Firm*—Costas, Montgomery & Dorman

[57] ABSTRACT

A fluid operated pintle assembly for rotatively supporting a reel where the pintle is carried on a piston within a cylinder and the piston is spring biased to a reel engaging position and retracted under fluid pressure only when a blocking mechanism is retracted. The blocking mechanism comprises a fluid actuated piston cylinder assembly having a stop member which may be received in a cavity in the pintle piston to permit retraction of the piston or inserted between the piston and the bottom of the cylinder to prevent retraction of the piston.

4 Claims, 7 Drawing Figures

REEL SUPPORT SYSTEM

FIELD OF THE INVENTION

This invention relates to reel carrying systems wherein wire is payed off from a reel and more particularly relates to an improved actuating system for reel supporting pintles.

BACKGROUND OF THE INVENTION

In a wire stranding system, wire is payed off from a plurality of reels to a stranding station. As the wire on a reel is exhausted, the reel must be replaced with one from a fresh supply of wire. The reels are rotatably supported in cradles which are also rotatably mounted. It is common practice to have the reels rotatably mounted on pintles which are fluid actuated to release the reel, while being spring biased into a reel engaging position.

U.S. Pat. No. 4,406,423 discloses a new and improved pintle actuating system of the fluid operated type in which the pintles are actuated to disengage a reel upon application of fluid pressure using a piston-cylinder arrangement.

The invention described in the aforementioned patent further provides an improved and simplified warning and safety device, which until actuated, will not permit retraction of the piston and the pintle therewith; and, further provides means for always signifying when the pintle is not in a full engaging position with the reel. A pintle actuating device may generally be considered as a spring biased device for engaging a reel and a fluid actuated retract system.

In the present invention, substantial clearance may be left between the piston and cylinder walls and an annular diaphragm is provided overlying a wall of the piston and the cylinder defining means, and defining a seal therebetween. Then, when fluid pressure is applied to the piston, there need be no sealing engagement or close contact between the piston and cylinder inasmuch as the diaphragm provides a seal and will in essence roll with movement of the piston in the cylinder, in the clearance therebetween. One or more guide pins may be provided for maintaining the axial position of the piston and the cylinder. The piston itself rotatably carries the pintle which engages the reel. Radially extending through the cylinder defining means is a retaining pin which normally closes a fluid passage to the cylinder, and maintains the piston in a given reel engaging position. Before the piston can be retracted to disengage the reel, the pin must be moved, under the influence of fluid pressure, to uncover a passageway into the piston-cylinder assembly. The pin is arranged so that when it is retracted, an indication is given that the pintle is not in a reel engaging position. Upon reactuation of the pintle to again engage a reel, the safety device will alert the operator whenever the pintle is not in a full reel engaging position. However, when the pintle is in the full engaging position, the warning is extinguished.

In practice, it has been found that under unexpected and severe operating conditions where the strand breaks, the cradle may rotate uncontrollably and cause the pintle piston therein to retract and shear a retaining pin. This may cause the reel to lose engagement with the pintle and fly from the pintle. While such situations are rare, adequate means should be provided to guard against the occurrence.

SUMMARY OF THE INVENTION

The present invention includes the general structure of the aforementioned patent. The pintle piston is biased into a reel engaging position by a plurality of springs disposed about the axis of the piston. Extending radially through the cylinder wall is a piston-rod carrying thereon a blocking member which in the reel engaging position of the piston, extends between the piston and the cylinder head and blocks retraction of the piston should forces on the springs tend to move the piston toward a retracted position. A cavity is defined in the piston to receive the blocking member and the radially extending piston rod when the piston rod is retracted and thereafter permit fluid pressure to be admitted into the main cylinder to retract the pintle piston. The blocking member, in an operative position, causes the pintle piston to bottom on the blocking member and prevent retraction thereof.

An object of this invention is to provide a new and improved pintle assembly for supporting a reel.

The features of the invention which are believed to be novel are particularly pointed out and distinctly claimed in the concluding portion of this specification. The invention, together with further objects and advantages thereof, may best be appreciated by reference to the following detailed description and the drawings.

BRIEF DESCRIPTION OF THE DRAWINGS

FIG. 6 is an enlarged sectional view of a cradle supporting bearing assembly of FIG. 1.

DETAILED DESCRIPTION OF THE ILLUSTRATED EMBODIMENT

Figure 1:
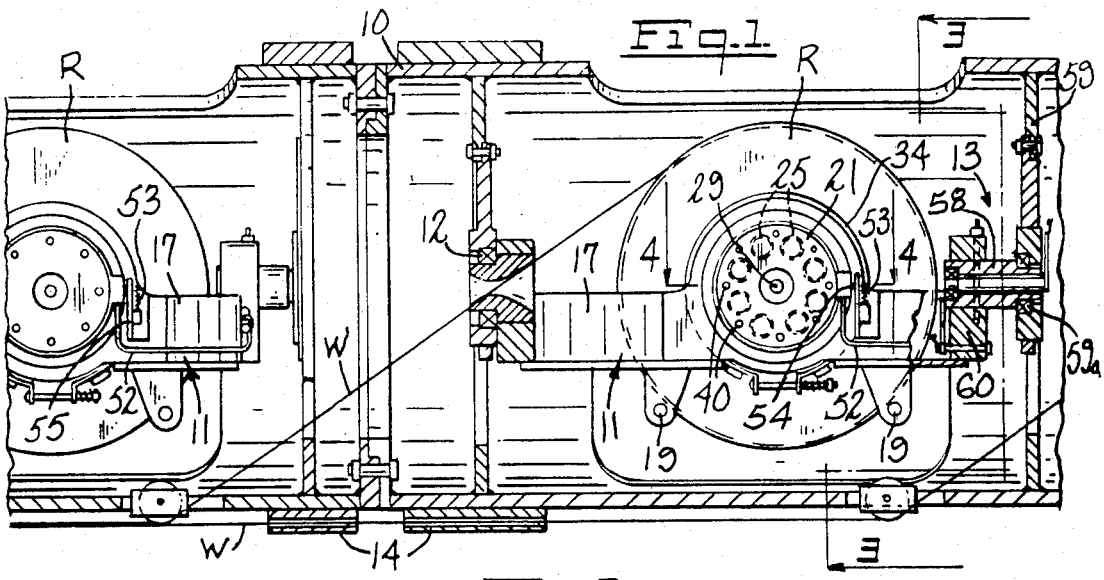
FIG. 1 is a side elevation partly in section of a portion of a wire stranding machine.
Figure 2:
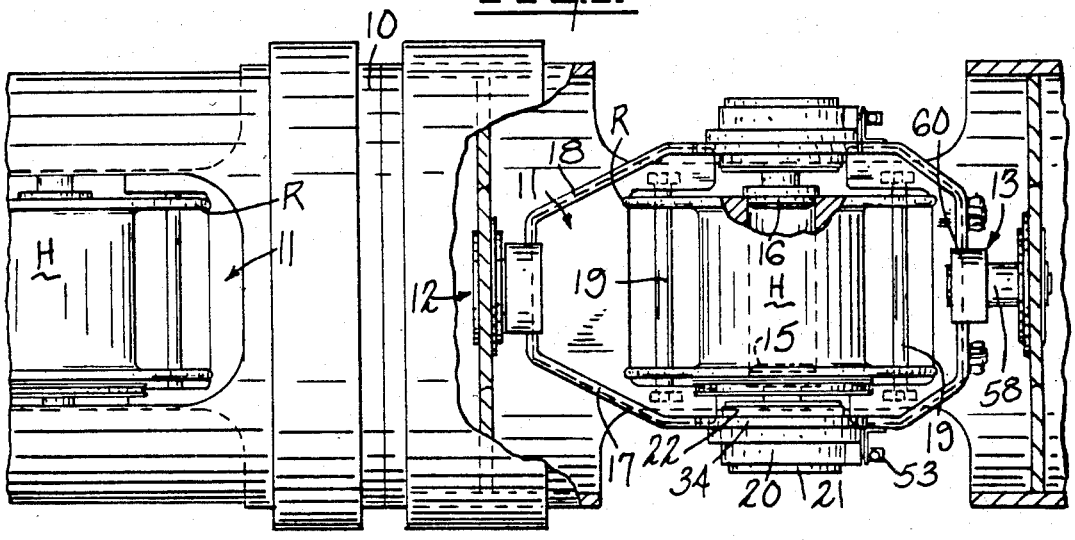
FIG. 2 is a plan view of the device of FIG. 1 with the exterior housing partially cut away.
Figure 4:
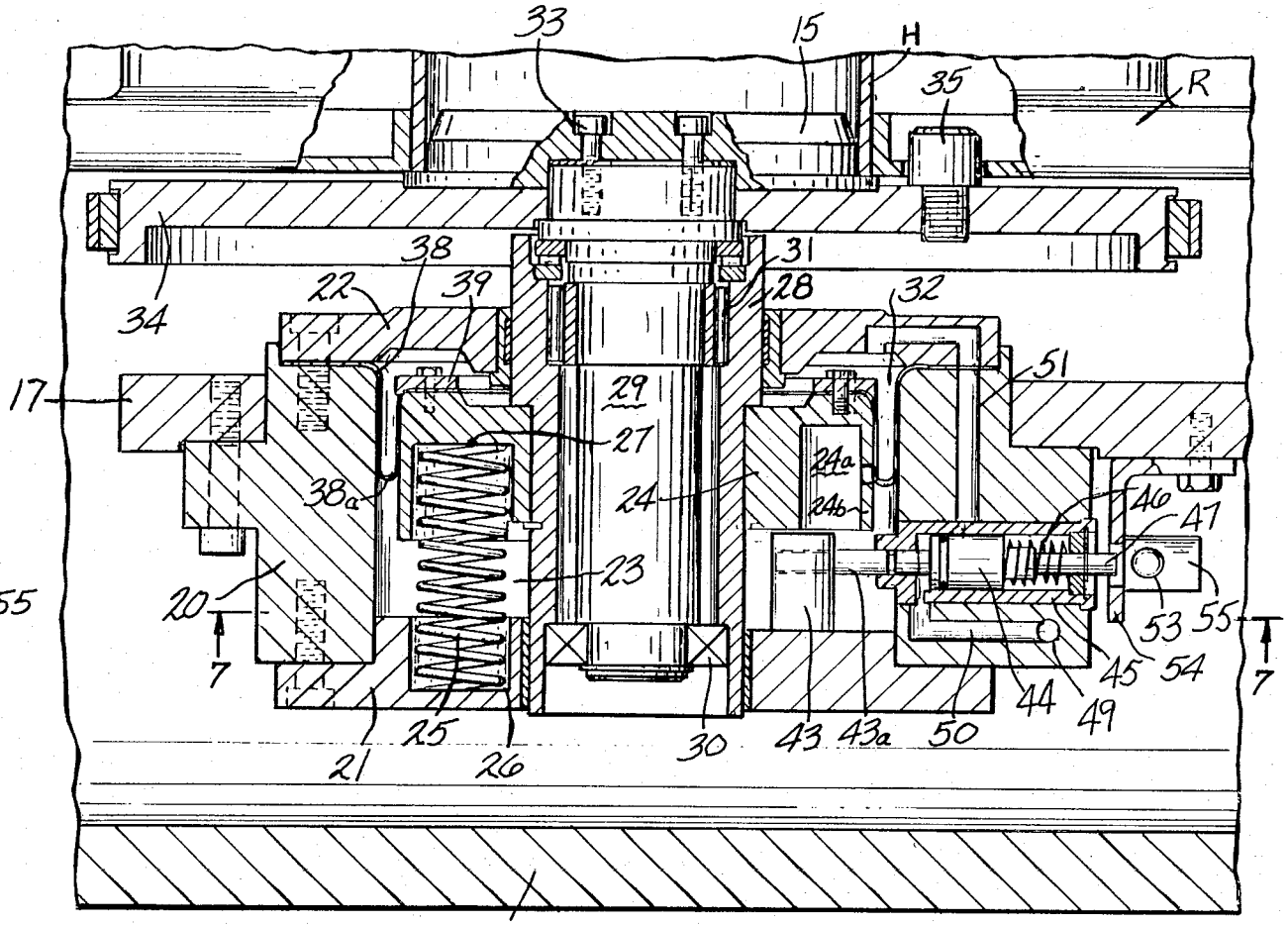
FIG. 4 is a sectional view seen in the plane of lines 4—4 of FIG. 1 showing the pintle-cylinder assembly.
Figure 5:
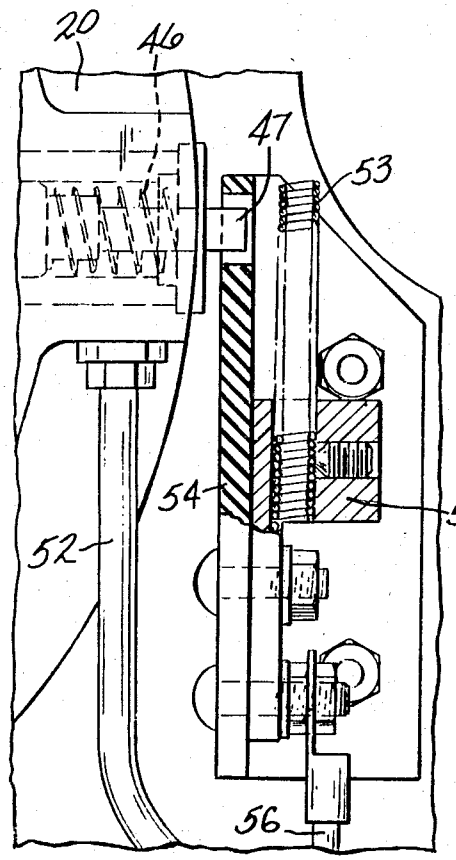

As shown in FIG. 1, the tube 10 of a wire stranding machine pivotally supports a plurality of cradles 11 on bearing assemblies 12 and 13. Each cradle 11 rotatably supports thereon a reel to pay out wire W to a stranding die, not shown, through guides 14. The reels are supported on rotatable pintle assemblies 15 and 16. The pintles are rotatably mounted on the pistons of cylinder assemblies, mounted to spaced apart walls 17 and 18 of cradle 11. Retaining rods 19 extend between walls 17 and 18 beneath a reel. Each of the cylinder assemblies include a body member 20 secured to a cradle wall 17, as shown in FIG. 4. An end cap member 21 and a front wall member 22 together with body member 20 define a cylindrical cavity 23. An end cap member provides a head for the cylinder. A piston 24 is received in cavity 23 and is biased towards a reel engaging position by a plurality of springs 25 received in seats 26 in end cap 21 and seats 27 in piston 24. The pintle assemblies 15 and 16 are identical except for the inclusion of a brake ring 34.

Extending through piston 24 in a sleeve 28 is a pintle shaft 29 rotatably supported by bearings 30 and 31. The pintle 15 is secured as by means of bolts 33 to the end of shaft 29. A brake ring 34 is carried on the pintle shaft of pintle assembly 15. A drive dog 35 for engagement with a reel is carried on brake ring 34.

As shown, the pintle 15 is in its extended position engaging hub H of reel R.

Figure 7:
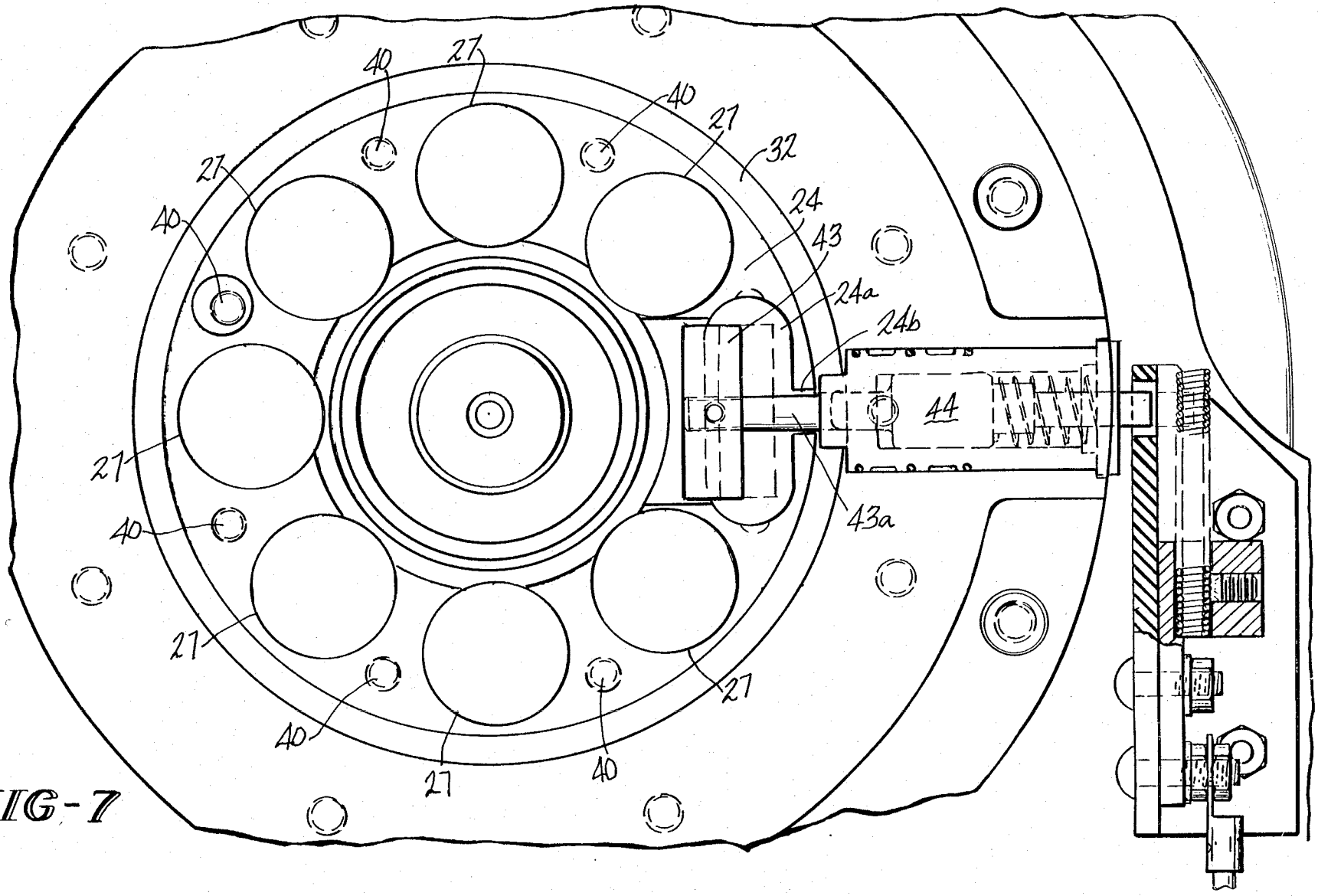
FIG. 7 is a view seen in the plane of lines 7—7 of FIG. 4.

Substantial clearance is provided between the outer surface of piston 24 and the internal surface of cylinder 23. An annular diaphragm 38 is secured between body member 20 and front end cap 22, and also by an annulus 30. The diaphragm 38 extends with a U-fold 38*a* into the clearance between the piston and the cylinder and defines a fluid pressure chamber 32 between piston 24, end cap 22, and body member 20. A plurality of guide pins 40 (FIG. 7) extend from piston 24 into passage 41 in end cap 21 and maintain alignment of piston 24 with the cylinder.

When chamber 32 is pressurized with fluid to a sufficient extent, piston 24 will retract from a reel engaging position against the bias of springs 25. Before this can occur a fluid actuated means must be operated to move a blocking member 43 from a radially extended position in which it blocks the undersurface of piston 24 from retraction while bottoming on end wall 21. Member 43 is on a rod 43*a* extending from a piston 44 in a cylinder 45. Piston 44 is normally biased by a spring 46 towards a blocking position. The other end of piston 44 includes a contact extension rod 47 to provide a visual or audible signal when the pintle is not in a reel engaging position, as hereinafter described.

A recess 24*a* is defined in piston 24 to receive blocking member 43 and permit piston 24 to retract when piston 44 is retracted. A slot 24*b* is also defined in piston 24, communicating with cavity 24*a*. Slot 24*b* receives a rod 43*a* therein when piston 24 is retracted.

When rod 43*a* is in an extended position, as shown in FIG. 4, blocking member 43 provides a solid stop for piston 24 and transmits any forces attempting to retract piston 24 to end cap 21. Thus, piston 24 is positively blocked against retraction.

Piston 44 will move blocking member 43 to the right to an unblocking position in alignment with recess 24*a* when fluid pressure is applied through an inlet 49. A fluid passage 50 from inlet 49 is defined in body member 20 leading to the left end (as shown) of cylinder 45. As the chamber is pressurized, piston 44 will move to the right (as shown) and provide communication from cylinder 45 to a fluid passage 51 leading to chamber 32. Then, only after retraction of blocking member 43 to a position in alignment with recess 24*a*, may the pintle assembly be retracted from a reel engaging position. As the piston 24 is retracted, the diaphragm, as indicated at 38*a*, will in essence roll along the walls of piston 24 and cylinder 23. By providing this cylindr construction, seals such as packing or rings are obviated and the possibility of fluid leakage is substantially eliminated.

Figure 5:
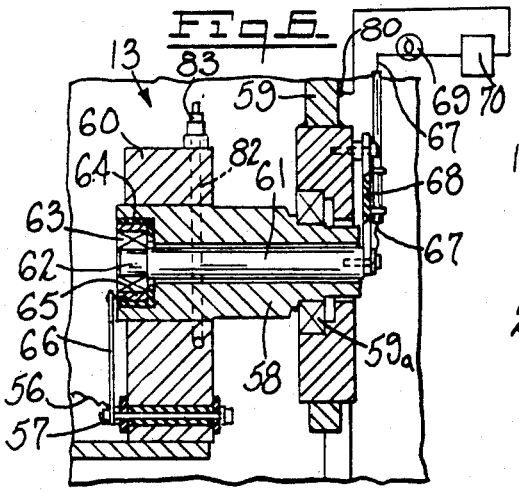
FIG. 5 is an enlarged view, partly in section, of a portion of FIG. 1.
Figure 3:
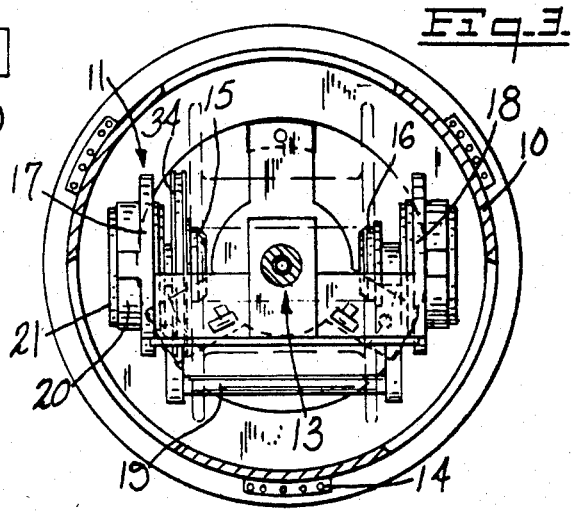
FIG. 3 is a section seen in the plane of lines 3—3 of FIG. 1.

As shown in FIG. 5, a fluid line 52 is coupled to inlet 49 and pin 47 is shown partially extending from housing 20. When piston 44 is moved to a retracted position, rod 47 will make electrical contact with a spring 53. Spring 53 is carried on an insulating bracket 54 on the wall of the cradle, and is electrically connected through a holder and terminal plate 55. A lead 56 extends from plate 55 to a terminal 57 (FIG. 6) on support assembly 13.

Cradle bearing assembly 13 includes a support shaft 58 pivotally mounted in wall 59 by a bearing assembly 59*a*. An upright extension 60 of cradle 11 is carried on shaft 58. A spindle 61 extends through a bore in shaft 58, and has an end 62 received in a bearing assembly 63. Bearing assembly 63, and hence spindle 62, is electrically insulated from shaft 58 by a cup-shaped member 64. Terminal 57 is connected to bearing sleeve 65 by a strap 66. A further connection is made from spindle 61 to a lead 67. Spindle 61 is not in contact with shaft 58 and is prevented from rotation by a strap 68.

A warning device, exemplified as a lamp 69, is connected between a source of electricity indicated by terminal 70 and lead 67. Thus, when contact 47 engages spring 53, a path to ground from terminal 80 is established through warning device 69. The warning indicator, which most likely would be a lamp, will be mounted in a convenient place generally on the tube adjacent each cradle to inform the operator when the pintles are not in a reel engaging position and, therefore, the operator will not put a new reel on line if such an indication occurs.

When fluid chamber 32 is purged, the exiting fluid will hold piston 44 in a retracted position. As the fluid pressure decreases, springs 25 will urge the pintle toward a reel engaging position until the piston with pintle thereon reach the reel engaging position shown in FIG. 4. At this time, spring 46 retracts piston 44 and contact 47 will leave spring 53. Then the warning indicator will be extinguished.

The operation of the safety indicator and the pintle upon retraction are sequential and the pintle cannot be retracted until piston 44 removes member 43 from a blocking position. The piston and pintle may move freely with respect to the cylinder wall when blocking member 43 is retracted by virtue of the clearance between the piston and cylinder wall. This clearance provides a simplified and maintenance free construction.

A fluid passage 82 with connecting nipple 83 (FIG. 6) may be provided in cradle 18 to supply fluid pressure to both of the cylinders.

While a preferred embodiment of the invention has been described, alternate embodiments, as well as other embodiments may occur to those skilled in the art. Accordingly, the appended claims are intended to encompass all modifications and embodiments of the invention which do not depart from the spirit and scope of the invention.

Having thus described the invention, what is claimed is:

1. A system for rotatably supporting a reel on spaced apart pintles including a cradle having spaced apart walls, means defining a cylinder attached to at least one of said walls, said cylinder having a head, a piston having a head in said cylinder, said piston having walls defining a central bore and a peripheral wall, a pintle rotatably carried in said piston bore, a plurality of springs disposed between the walls defining said bore and said peripheral wall and biasing said piston toward an extended position to cause said pintle to engage a reel, a piston blocking member in said cylinder arranged to engage said piston and contact said cylinder head to prevent retraction of said pintle from a reel engaging position, a recess defined in said piston arranged to receive said blocking member and permit retraction of said piston when said blocking member is aligned with said recess, a fluid passage defined in said cylinder defining means to the head of said piston, fluid operated means mounted in said cylinder defining means and extending radially inwardly of the defined cylinder to said blocking member, said fluid operated means normally positioning said blocking member to prevent retraction of said piston and blocking said fluid passage, but being responsive to application of fluid pressure to said fluid passage to retract and permit fluid pressure to be applied to said piston head and move said blocking member to a position aligned with said recess.

2. The system of claim 1 where said fluid operated means comprises a piston-cylinder assembly in said fluid passage, the piston of said assembly blocking said fluid passage until retracted by fluid pressure whereby said pintle carrying piston cannot be retracted until the piston of said piston-cylinder assembly is retracted and aligns said blocking member with said recess.

3. The system of claim 1 further including means responsive to retraction of the piston of said piston-cylinder assembly for indicating said pintle carrying piston is retracted.

4. The system of claim 2 whereby a rod extends from one end of the piston of said piston-cylinder assembly to said blocking member and a second rod member extends from the other end of said piston of said piston-cylinder assembly adapted to complete an electrical circuit for indicating said pintle carrying piston is retracted.

* * * * *